United States Patent [19]

Fleming

[11] Patent Number: 4,654,989

[45] Date of Patent: Apr. 7, 1987

[54] VERTICAL THREE-DIMENSIONAL IMAGE SCREEN

[76] Inventor: Ward Fleming, 88 W. Broadway, New York, N.Y. 10007

[21] Appl. No.: 766,872

[22] Filed: Aug. 16, 1985

Related U.S. Application Data

[60] Division of Ser. No. 527,741, Aug. 30, 1983, Pat. No. 4,536,980, which is a continuation-in-part of Ser. No. 423,114, Sep. 24, 1982, abandoned, which is a division of Ser. No. 91,125, Mar. 21, 1980, Pat. No. D. 270,317.

[51] Int. Cl.[4] ..... A47F 11/06

[52] U.S. Cl. ..... 40/427; 40/579; 446/118

[58] Field of Search ..... 40/579, 447, 427; 46/16; 248/316.1; 433/72, 75; 33/174 D

[56] References Cited

U.S. PATENT DOCUMENTS

| | | | |
|---|---|---|---|
| D. 270,317 | 8/1983 | Fleming | D6/177 |
| 2,100,148 | 11/1937 | Parker | 40/28 |
| 3,400,478 | 9/1968 | O'Keefe | 40/447 |
| 3,568,357 | 3/1971 | Lebensfeld | 40/579 |
| 3,586,248 | 6/1971 | Riebold | 248/316.1 |

FOREIGN PATENT DOCUMENTS

| | | | |
|---|---|---|---|
| 2357621 | 5/1975 | Fed. Rep. of Germany | 40/579 |
| 907977 | 3/1946 | France | 33/512 |
| 2267736 | 11/1975 | France | 33/512 |
| 112002 | 9/1980 | Japan | 33/515 |
| 2037471 | 7/1980 | United Kingdom | 40/579 |

OTHER PUBLICATIONS

"The Tactile Multiple", by John Ballantine, *Art in America*, p. 141, Jul. 1978.

Dimensions, Inc., brochure, Jul. 13, 1967.

Specialized Forms of Animation, by Alexander Alexeieff & Claire Parker, pp. 304–305.

The Animation Book, by Kit Laybourne, cover page, and pp. 152–154.

ASIFI Information Bulletin, pp. 90–99, published 1972, describing Alexander Alexeieff's and Claire Parker's animation work.

Fuji T-120; Pin Screen, 116C 0173 031; 38 min., 53 sec.; National Film Board of Canada.

*Primary Examiner*—Robert P. Swiatek

*Assistant Examiner*—Cary E. Stone

*Attorney, Agent, or Firm*—Parmelee, Bollinger & Bramblett

[57] ABSTRACT

A pin screen has at least one and preferably two vertically aligned spaced plates having a plurality of closely spaced, small apertures each of which is adapted to receive a pin held in selected positions by frictional engagement in a horizontal pin orientation. A transparent sheet of material is vertically spaced a predetermined distance in front of said vertical plate or plates. The pins are longer than the separation between the plate or plates and the transparent sheet. The size of the pin head prevents the pins from passing through the apertured plates and the transparent cover prevents them from falling out of the apertures. A contoured three-dimensional image is created by the selective horizontal displacement of pins relative to the vertical apertured plate, and the displaced pins remain in their three-dimensional, image-creating position held there by friction until intentionally displaced to a different position.

8 Claims, 5 Drawing Figures

VERTICAL THREE-DIMENSIONAL IMAGE SCREEN

BACKGROUND OF THE INVENTION

The present invention is a division of U.S. patent application Ser. No. 527,741, filed Aug. 30, 1983, issued as U.S. Pat. No. 4,536,980 on Aug. 27, 1985, which is a continuation-in-part of Ser. No. 423,114 filed on Sept. 24, 1982, and now abandoned, which itself is a divisional application of U.S. design patent application Ser. No. 091,125 filed Mar. 21, 1980, issued as Design Pat. No. Des. 270,317 on Aug. 30, 1984.

The invention described herein and in the applications referred to above is designated as a pin screen. The pin screen is a multi-purpose entertainment device. It functions as an artistic animation image producer or display by creating visual patterns resulting from the displacement of a plurality of pins relative to a supporting apertured plate. The pin screen is aesthetically appealing and also provides enjoyable participatory entertainment for both children and adults.

SUMMARY OF THE INVENTION

In carrying out this invention in one illustrative embodiment thereof, a pin screen for providing a three-dimensional image of an object applied thereto has at least one vertically oriented plate containing a plurality of closely spaced apertures. A plurality of pins having heads larger than the apertures are horizontally disposed and are held in their selected positions by frictional engagement in said apertures. The plate has a thickness less than the length of the pins exposing portions of pins which extend through the plate. The pins are adapted to be selectively axially displaced in said plate when the exposed end portions come into contact with an object creating a three-dimensional image of the object. A vertically oriented transparent cover parallel to the apertured plate is provided to prevent the pins from falling completely out of the plate head first.

In the preferred embodiment two spaced, thin, parallel plates with aligned horizontal apertures are employed. If a single plate is used, it must be thicker to retain the pins in displaced position so that the pins will not pivot when displaced in order to provide a truer three dimensional image. In either embodiment, the pins are longer than the separation between the plate or plates and the transparent cover.

DESCRIPTION OF THE PREFERRED EMBODIMENT

Figure 3:
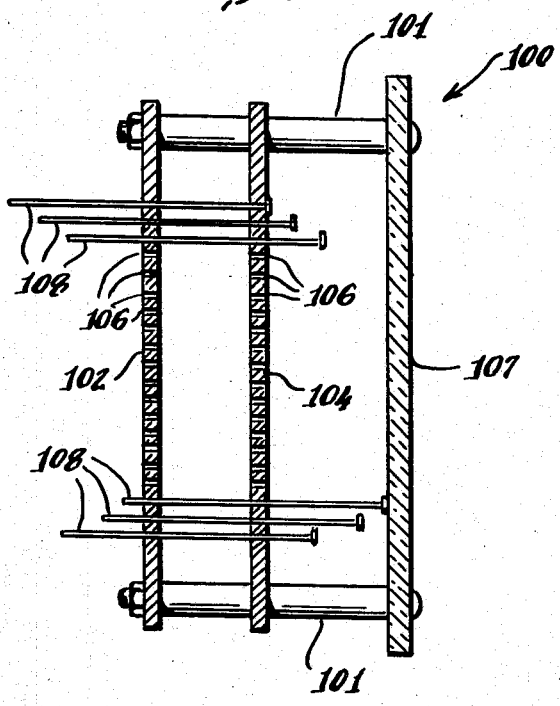
FIG. 3 illustrates the embodiment shown in FIG. 1 in which a transparent sheet has been added to limit the degree of horizontal displacement of the pins and to retain the pins.
Figure 4:
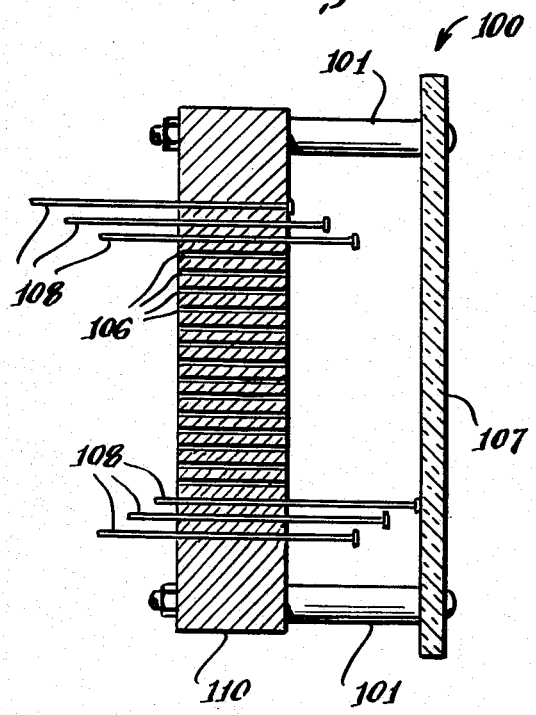
FIG. 4 illustrates the embodiment shown in FIG. 2 in which a transparent sheet has been added to limit the degree of horizontal displacement of the pins and to retain the pins.
Figure 5:
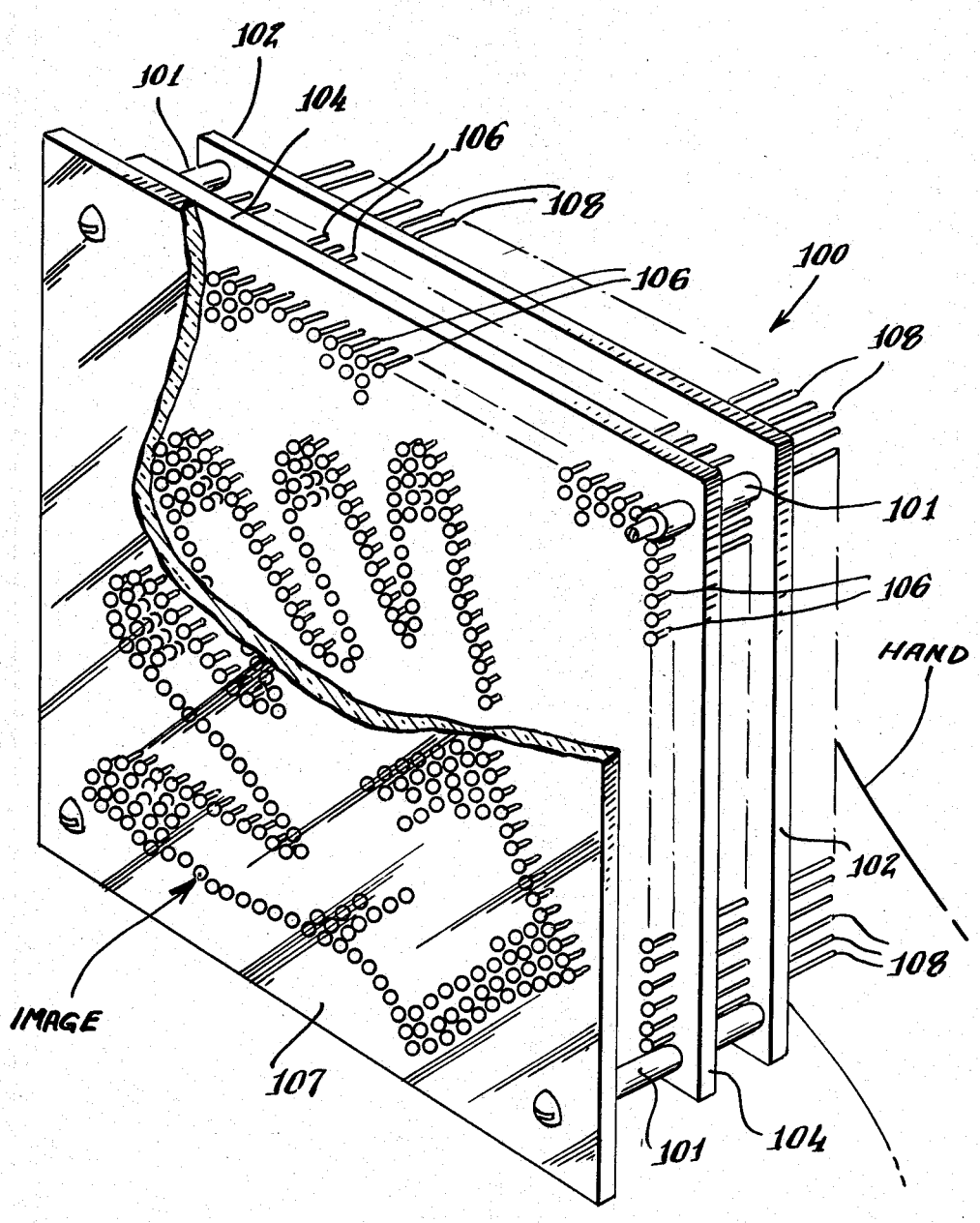
FIG. 5 is a perspective view of the pin screen illustrated in FIG. 3 showing a three-dimentional image resulting from the selective horizontal displacement of the pins.

The preferred embodiments of a three-dimensional, image-creating pin screen in accordance with the present invention is illustrated in FIGS. 3, 4 and 5 of the drawings.

Figure 1:
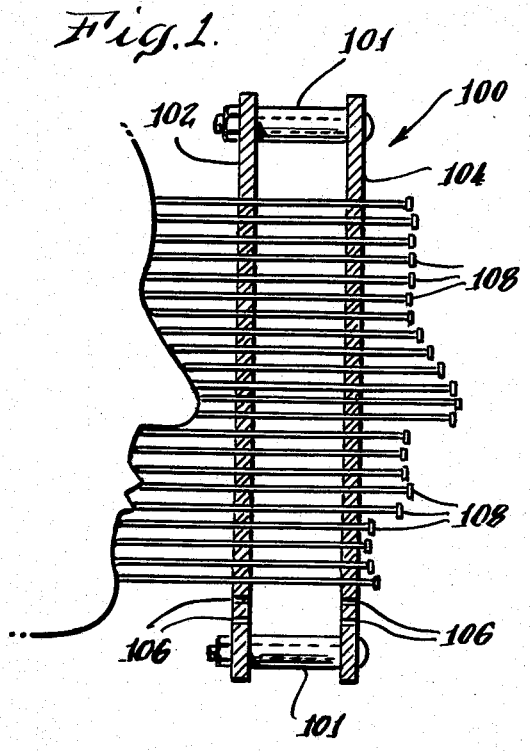
FIG. 1 is a side view, in section, illustrating an embodiment of the invention in which the pin screen has two vertical apertured plates and the pins are displaced horizontally.

In FIG. 1, a vertically oriented housing 100 includes two parallel vertical apertured plates 102 and 104. The two vertical plates have horizontally aligned apertures 106, and the plates are spaced a predetermined distance apart by bolts and spacers generally designated by reference numeral 101. As seen in FIG. 1, the spacers are tubes surrounding the shanks of the bolts. A plurality of pins 108 have their shanks received in and inserted through the respective aligned openings or apertures 106 defined in both parallel vertical plates. Each pin 108 is inserted through one opening in the first plate 102 and the same pin extends to and is inserted through the corresponding horizontally aligned opening in the second plate 104. The spacing between the two vertical plates is less than the length of the pins.

As illustrated in FIG. 1, the pins 108 are inserted through the parallel plates such that the respective pin heads are closest to apertured plate 104, while the ends of the pins are closest to the apertured plate 102. The user of the pin screen may selectively displace the pins by pressing against the pin ends extending through the left side of the plate 102 to horizontally displace pins and pin heads towards the right in FIG. 1. For example, the user may force his face against the pin ends on the left side of plate 102, resulting in pins corresponding to the three-dimensional configuration of the face being displaced towards the right. The horizontally displaced pin heads, when viewed from the right side of plate 104, recreate a three-dimensional configuration of the object displacing the pins, which in the above example, is the user's face. The pins are held in their displaced positions in the respective apertures in plates 102 and 104 by frictional engagement between the bodies or shanks of the pins and the apertured plates. The spacing between the two vertical plates is sufficiently great to assure that the horizontally displaced pins 108 will not pivot and slope down significantly below horizontal relative to the two vertical apertured plates, but will remain horizontally oriented.

Preferably, the pins will be about 3 inches in length and the plates will be separated by a distance less than the length of the pins. Preferably, the plates will be separated by about ½ inch but not more than about 2½ inches to allow at least a ½ inch range of horizontal displacement of the pins. The plates may be formed from 22 gauge steel or from phenolic or other rigid plastics. The pin shanks may be about 1/16 inch in diameter and the apertures in the plates will be slightly larger than the diameter of the shanks. The pins heads are sufficiently large to prevent the heads from passing through the apertures, preferably about ⅛ inch. The ends of the pins will be flat or rounded and not pointed to prevent injury or damage to the objects pressed against them. In the preferred embodiment of the vertical pin screen, the spacing of the apertures 106 in each apertured plate is about 7/64 inch center to center. The apertures in the plates can be defined in a staggered row pattern with alternate rows aligned.

FIG. 3 is similar to the embodiment of FIG. 1 except that the pin screen housing 100 now includes a vertical transparent cover 107 parallel to the plates 102 and 104 and spaced to the right of plate 104. The distance between the transparent cover and the leftmost apertured plate 102 must be less than the length of the pins, preferably about ½ inch less. In the embodiment of FIG. 3, the heads of horizontally displaced pins abut against the transparent cover, thus preventing a user from pushing the pins completely out of the apertured plates. The transparent cover may be a thin glass or plastic sheet and can be supported in vertical position by extended bolts and spacer elements 101 extending from apertured plate 104.

In both the FIGS. 1 and 3 embodiments of the invention, the displaced pins are returned to the initial position (in which the pin heads abut against the right side of the apertured plate 104) by gravitational forces by lifting the housing 100 and tilting it to the left. Also, in the FIG. 1 embodiment, the displaced pins may be returned to the initial position by physically pushing the pin heads to the left from a position to the right of apertured plate 104.

Figure 2:
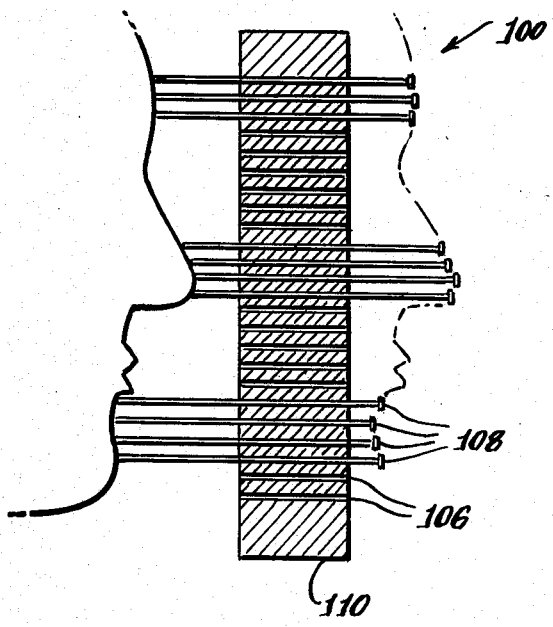
FIG. 2 is a side view, in section, similar to the vertical pin screen of FIG. 1 except this embodiment includes only a single vertically oriented apertured plate.

The embodiments of FIGS. 2 and 4 are substantially identical to the embodiments of FIGS. 1 and 3, respectively, with one exception. Instead of the two relatively thin parallel apertured vertical plates 102 and 104 of the FIGS. 1 and 3 embodiments, the FIGS. 2 and 4 embodiments include a single thick apertured vertical plate 110. The thickness of the single plate 110 must be less than the length of the pins, and is approximately equal to the separation distance of plates 102 and 104 of FIGS. 1 and 3. The pins are held in the single plate 110 by frictional engagement therewith, and the plate is sufficiently thick (e.g., ½") relative to the length of the pin shanks (e.g., 3") to prevent pivoting of the pins and to maintain the horizontal orientation of the pins. The operation and structure of the FIGS. 2 and 4 vertical pin screen embodiments, except as noted herein, are identical to that of FIGS. 1 and 3. Accordingly, corresponding reference numerals have been used for corresponding structure.

FIG. 5 is a perspective view of the embodiment of the vertical pin screen of FIG. 3. FIG. 5 shows the three-dimensional configuration of the head ends of the pins as viewed from the right side of any of the embodiments of FIGS. 1–4. The three-dimensional image of a hand is formed by the horizontal displacement of pin heads resulting from the impression of the image to be reproduced against the ends of the pins extending from the left side of the pin screen illustrated in FIG. 3. This three-dimensional image of the hand created by the displaced head ends of the pins will be retained until the positions of the pins is restored to their initial non-displaced positions in the plates or otherwise varied from the positions illustrated in FIG. 5.

What is claimed is:

1. A vertically orientable pin screen for providing a three-dimensional image of a three-dimensionally configured object applied thereto comprising:

first and second spaced parallel vertically orientable apertured interconnected plates adapted to receive and hold a plurality of pins inserted into the apertures in said two plates, said respective apertures in said respective plates when said plates are vertically oriented being in horizontal alignment such that a pin inserted through said aligned apertures in each of said plates will be horizontally oriented, said apertures in each of said plates being aligned in rows, said rows being in a staggered pattern with said apertures in alternate rows being aligned with each other, a plurality of pins each having a shank with a head on one end thereof and with the other end of the shank being blunt, said apertures being slightly larger than the shanks of said pins, said shanks being inserted through aligned apertures in said first and second plates with said heads abutting against said first plate, each pin having a head larger than said apertures to prevent said pins from passing through said apertures, said first and second plates being spaced apart from each other a distance less than the length of said pins inserted through said apertures in said plates for allowing the end portions of their shanks to project beyond said second apertured plate when said heads are abutting against said apertured plate, said spacing of said plates being sufficient to maintain said pins inserted through said aligned apertures in said respective plates in a substantially horizontal orientation when said plates are vertically oriented, said plates being adapted to allow selective horizontal displacement of said pins relative to said plates when said plates are vertically oriented, a transparent cover mounted in a plane parallel to said first and second apertured plates and being spaced from said first apertured plate, said first apertured plate being disposed between said transparent cover and said second apertured plate, the spacing between said transparent cover and said first apertured plate being less than the length of said pins inserted through said apertured plates for limiting the displacement of said pins in said apertures and preventing the pins falling out of said plates head first, said pins being horizontaly displaceable by pressing a three-dimensionally configured object against said end portions of their shanks projecting beyond said second apertured plate for displacing away from said first apertured plate and toward said transparent cover the heads of those pins whose end portions have been pressed by such object for causing the displaced heads as seen through said transparent cover to create a three-dimensionally configured image of such object, said displaceable pins being held in their respective displaced positions by frictional engagement of the shanks of the pins in said apertures for retaining said three-dimensionally configured image while said plates are vertically oriented, and said pins being returnable to their original positions in which their heads are abutting against said first apertured plate by gravitational force by lifting and tilting said pin screen with the end portions oriented downwardly.

2. The pin screen as claimed in claim 1, wherein said apertures in a staggered row pattern are spaced about 7/64th of an inch center to center, and the pin heads are about ⅛th inch in size.

3. A liftable, tiltable and vertically orientable pin screen comprising:

first and second apertured plates, a transparent cover, mounting means mounting said first and second apertured plates and said transparent cover in spaced parallel relationship with respect to each other with said transparent cover being spaced from and parallel to said first apertured plate and with said first apertured plate being located between said cover and said second apertured plate and being parallel to said second apertured plate, numerous identical pins each having a shank with a head on one end and a blunt other end, said first and second apertured plates each having rows of apertures, the respective apertures in the rows in said first apertured plate being aligned with the respective apertures in the rows in said second apertured plate, said apertures being larger than the diameter of said shanks, said heads of the pins being larger than said apertures, said shanks extending through aligned apertures in said first and second plates with said heads initially abutting against said first apertured plate, said shanks being longer than the spacing between said plates for causing said other ends of the shanks to project beyond said second plate when the heads are abutting against said first plate, said shanks being freely displaceable in an axial direction through said apertures, with said plates and said transparent covering being oriented in vertical parallel planes, said shanks become oriented horizontally and said shanks are then horizontally displaceable for moving said heads away from said first plate and toward said transparent cover by pressing a three-dimensionally configured object against said other ends of said shanks for causing the displaced heads to create a three-dimensionally configured image of such object seen through said transparent cover, said horizontally oriented freely displaceable pins being held in their displaced positions by friction in the respective aperatures through which said shanks extend, said first and second apertured plates being spaced sufficiently far apart for assuring that the horizontally displaced pins will not pivot and slope down significantly below horizontal, said heads being returnable to their initial position abutting against said first plate by gravitational force by lifting and tilting said pin screen with the other ends of the shanks being oriented downwardly, and said transparent cover being sufficiently close to said first apertured plate for preventing the pins from falling out of said apertured plates head first.

4. The pin screen as claimed in claim 3, in which:

said apertures in each of said plates are spaced about 7/64ths of an inch center to center and the pin heads are about ⅛ inch in diameter.

5. The pin screen as claimed in claim 3, in which:

said transparent cover is spaced farther from said first apertured plate than said first apertured plate is spaced from said second apertured plate for allowing at least a range of ½ inch displacement of the pins.

6. The pin screen as claimed in claim 5, in which:

said pins are about 3 inches long.

7. A pin screen for providing a three-dimensional pattern of an object applied thereto comprising:

two spaced normally vertically oriented parallel apertured plates mounted to each other and each having a plurality of closely spaced normally horizontal apertures, said apertures being aligned in rows, said rows being arranged in a staggered row pattern, said apertures in alternate rows being aligned with each other, the apertures in said plates being aligned with each other, a plurality of pins all of the same size and shape each having a shank with a pin head on one end of the shank, said apertures in said plates being slightly larger than the diameter of said shanks, said pin heads being larger than the apertures in said plates for preventing said pins from passing through said apertures in said plates, said plurality of pins being disposed in said apertures in said plates and normally being retained in their horizontal positions in said apertures by frictional engagement in said horizontal apertures in said plates when said plates are normally vertically oriented, the horizontal distance between said two apertured plates being less than the length of said pin such that a pin inserted through an aperture in one of apertured plate extends horizontally through the corresponding aligned aperture in the other parallel apertured plate with the end portion of the pin projecting beyond said other apertured plate for enabling such three-dimensionally contoured object to be pressed against the projecting end portion of the pin, said end portions of said pins being non-pointed, a transparent cover mounted parallel to and spaced from one said apertured plate, said transparent cover being faced by the heads of said pins, the distance between said transparent cover and said one apertured plate being less than the length of said pins for preventing said pins from being displaced out of said plate in the direction of their heads, said pins normally being oriented in a horizontal direction and the end portions extending through said other plate being adapted to be selectively displaced relative to said plates by pressing a three-dimensionally contoured object against said non-pointed end portions for displacing those pins which are contacted by said object for causing the displaced heads thereof as seen through said transparent cover to create a three-dimensionally contoured image of the corresponding three-dimensionally contoured object which contacts and selectively displaces said pins, said pins retaining their respective displaced positions by frictional engagement in said horizontal apertures in said plates for retaining said three-dimensionally contoured image, and said displaced pins being returnable to their original positions in which the pin heads abut against said apertured plate by gravitational force by lifting and tilting said pin screen with the end portions of the pins downwardly.

8. A liftable, tiltable and normally vertically oriented three-dimensional image screen comprising:

a vertical apertured plate having a front and a back, a transparent cover spaced from the front of said apertured plate, mounting means extending between said apertured plate and said cover for holding said cover spaced from and substantially parallel to said apertured plate, said vertical apertured plate having multiple rows of apertures extending horizontally through the plate, numerous identical pins each having a shank with a head on one end and a blunt other end, said apertures being slightly larger than the diameter of the shanks of said pins, said shanks of said pins extending horizontally through said horizontal apertures with said heads of said pins facing said transparent cover and said heads initially abutting against the front of said apertured plate, said horizontal shanks being longer than the thickness of said apertured plate from front to back for causing said blunt ends to project beyond the back of said apertured plate when said heads are abutting against the front, said horizontal shanks each being freely displaceable in an axial direction through the aperture in which the respective shank extends, said horizontal shanks of said pins having sufficient length relative to the thickness of said apertured plate from front to back for causing a projection of the blunt ends of said shanks horizontally far enough beyond the back of said apertured plate for allowing the horizontal shanks of the respective pins to be displaced axially by pressing a three-dimensional object against said blunt ends to move the heads of pins far enough horizontally to abut the heads of axially displaced pins against the transparent cover, said apertured plate having sufficient thickness from front to back relative to said length of the pin shanks to prevent pivoting of the pins for maintaining horizontal orientation of the pins in spite of said projection of their blunt ends far beyond the back of the apertured plate, said horizontal shanks being displaceable by pressing a three-dimensional object against their blunt ends for moving their heads horizontally away from the front of said apertured plate toward said transparent cover for causing the displaced heads to create a three-dimensionally configured image of such object as seen through said transparent cover, said horizontal freely displaceable shanks being held in their respective displaced positions by friction in the respective apertures for retaining said three-dimensionally configured image of said object, said pins being returnable to their initial positions with their heads abutting against the front of the apertured plate by gravitational force by lifting and tilting of the three-dimensional image screen with the blunt ends of the pin shanks facing downwardly, said heads of said pins being larger than said apertures for preventing the pins from falling out of the apertured plate blunt end first, and said transparent cover preventing the pins from falling out of the apertured plate head first when the three-dimensional image screen is lifted and tilted with the heads of the pins facing downwardly.

* * * * *